US009854850B2

(12) United States Patent
Rana et al.

(10) Patent No.: US 9,854,850 B2
(45) Date of Patent: Jan. 2, 2018

(54) FEMALE CROTCH ENHANCING ARTICLE

(76) Inventors: Amar Pal Singh Rana, Sunnyvale, CA (US); Nirmal Singh, Sunnyvale, CA (US)

( * ) Notice: Subject to any disclaimer, the term of this patent is extended or adjusted under 35 U.S.C. 154(b) by 1280 days.

(21) Appl. No.: 10/331,790

(22) Filed: Dec. 30, 2002

(65) Prior Publication Data

US 2004/0154079 A1 Aug. 12, 2004

(51) Int. Cl.
*A41B 9/04* (2006.01)
*A41B 9/00* (2006.01)

(52) U.S. Cl.
CPC ..... *A41B 9/004* (2013.01); *A41B 9/04* (2013.01)

(58) Field of Classification Search
USPC ..... 2/400, 403, 406, 408, 227, 228, 238, 67, 2/69, 79, 455, 463, 267, 73, 78.1–78.4, 2/275, 402, 456, 243.1; 450/92, 97–99, 450/156; 604/385–396; 602/67; 128/845, 883, 884, 885, 891, 917, 918
See application file for complete search history.

(56) References Cited

U.S. PATENT DOCUMENTS 3,295,530 A * 1/1967 Mayer et al. ..... 450/98
4,627,111 A * 12/1986 Storie ..... 2/69
4,967,768 A * 11/1990 Tatro ..... 128/891
5,285,531 A 2/1994 Nalbandian
5,483,705 A * 1/1996 DiMatteo ..... 2/466
5,749,101 A 5/1998 Breindel
5,996,120 A 12/1999 Balit
6,041,441 A * 3/2000 Counts et al. ..... 2/227
6,174,217 B1 1/2001 Judson
6,406,648 B1 6/2002 Noel et al.

OTHER PUBLICATIONS

"New Transformer" latex undergarment as seen on www.transformation.co.uk/cache2.html with website update date of Feb. 12, 2001, 1 page.*
The "Cyberskin Cyber Sex Buddy" Imitation Vagina as seen on www.zooscape.com, 2 pages.*
"Grape Scented Vagina" Imitation Vagina as seen at www.zooscape.com, 1 page.*
"Cyberskin Cyber Sex Buddy" as seen on www.nawtythings.com/formen3h.html Imitation Vagina with flat rear surface, 1 page.*
Cyberskin Cyber Sex Buddy at www.adulttoychest.com listed at www.recall.archive.org website showing web update for www.adulttoychest on Dec. 2000. (Indication that the product was available in Dec. 2000).1 page.*

(Continued)

*Primary Examiner* — Gloria Hale

(57) ABSTRACT

A female crotch enhancing article with cosmetic human female crotch enhancer volume which is positioned within the outer and inner layer of a human female garment's crotch which gives the simulated appearance of exaggerated contours and curves associated with the human female external genitalia without or with the simulated appearance of the exaggerated pudendal cleft associated with the human female external genitalia to provide the human female wearer with subtle understated sexual expression and subtle non-verbal communication.

3 Claims, 27 Drawing Sheets

(56) References Cited

OTHER PUBLICATIONS

Open Crotch Vagina Panties as seen at www.transformations.co.uk/cache3.html with www.webarchive.org printout showing Dec. 17, 2002 web update page. (Imitation vagina panties to wear under underwear as desired).3 pages.*
"Realistic Vaginas" as seen on www.transformation.co.uk/cache3.html and cache2.html, 4 pages showing imitation vaginas of latex attached to straps and panties.*
"Camel Toe Cup" Advertisement. (no date provided).*

* cited by examiner

FEMALE CROTCH ENHANCING ARTICLE

BACKGROUND OF THE INVENTION

1. Technical Field

The present invention pertains to human female crotch enhancing article to provide the human female wearer with subtle understated sexual expression and subtle non-verbal communication, short of exposing themselves when viewed on the outer crotch surface of a human female wearer's undergarments, lingerie, panty hose or outer garments of every day dress or casual usage or tight fitting clothing, body suits, swim suits, leotard, sports tights, or similarly thin or close-fitting outer garments and the like.

2. Glossary of Terms

The term undergarments for the human female crotch enhancing article refers to panties, boxers, bikinis, nylons, teddies, lingerie, swim suits, panty hose and the like and the term outer garments for the human female crotch enhancing article refers to every day dress or casual usage or tight fitting clothing, body suits, swim suits, leotard, sports tights, or similarly thin or close-fitting outer garments and the like. The human female crotch enhancing article also may be utilized for figure control garments or human female protective athletic garments and the like.

The human female "genitalia" or "external genitalia" is a collective term used to describe the visible external human female genital region extending from the mons pubis to the perenium.

The "exaggerated pudendal cleft" is a term used with the simulated appearance of the human female external genitalia and refers to all or any combination of labia majora as if spread open manually or as if the human female's thighs are far apart or as if labia majora is not spread open, labia minora, clitoris, clitoral hood and other externally visible parts of the female genitalia within the pudendal cleft as they appear to project out of the labia majora starting from anterior commissure of labia majora to posterior commissure of labia majora or part thereof associated with the human female external genitalia.

The item "pudendal region" refers to the externally visible female genitalia and is limited to labia majora, labia minora, the clitoris, and the vestibule.

The term "human female crotch enhancing element" refers an integral or separate volume of the human female crotch enhancing article of the type for placement on the outer crotch portion of a female garment, or a female crotch enhancing article of the type insertable into the space between the outer cloth layer and an inner cloth layer of a human female garment's crotch, or a female crotch enhancing article of the type for placement on the body facing side of a human female garment's crotch where the human female garment consists of an outer cloth layer and an inner cloth layer; and which gives the simulated appearance of exaggerated contours and curves associated with the human female external genitalia without the pudendal cleft associated with the human female external genitalia; or with the simulated appearance of the exaggerated pudendal cleft associated with the human female external genitalia with all or any combination of labia majora as if spread open manually or as if the human female's thighs are far apart or as if labia majora is not spread open, labia minora, clitoris, clitoral hood and other externally visible parts of the female genitalia within the pudendal cleft as they appear to project out of the labia majora starting from anterior commissure of labia majora to posterior commissure of labia majora or part thereof associated with the human female external genitalia.

3. Description of the Related Art

Padded clothing apparel has a long history of use in the clothing industry. For example, the padded brassiere, padded shoulder inserts have enjoyed success. Padded garments with permanently secured or removable pads have also been in use.

U.S. Pat. No. 5,285,531 issued to Nalbandian on Feb. 15, 1994 entitled, "Female Garment" describes a female garment consisting of an outer layer comprising the female garment material with single fold seam and a second layer attached on the inner surface of the outer layer and covers the single fold seam of the first layer to simulate the contours of the external female genitalia. In contrast, the present invention pertains to a female crotch enhancing article of the type for placement on the outer crotch portion of a female garment, or a female crotch enhancing article of the type insertable into the space between the outer cloth layer and an inner cloth layer of a human female garment's crotch, or a female crotch enhancing article of the type for placement on the body facing side of a human female garment's crotch where the human female garment consists of an outer cloth layer and an inner cloth layer; and with separate or integral cosmetic human female crotch enhancer volume which is at least partially or wholly formed by a cosmetic human female crotch enhancer element positioned on the human female garment's outer crotch portion or positioned on or within any combination of body facing side, outside or within the outer and inner layer of a human female garment's crotch which gives the simulated appearance of exaggerated contours and curves associated with the human female external genitalia without the pudendal cleft associated with the human female external genitalia; or with the simulated appearance of the exaggerated pudendal cleft associated with the human female external genitalia with all or any combination of labia majora as if spread open manually or as if the human female's thighs are far apart or as if labia majora is not spread open, labia minora, clitoris, clitoral hood and other externally visible parts of the female genitalia within the pudendal cleft as they appear to project out of the labia majora starting from anterior commissure of labia majora to posterior commissure of labia majora or part thereof associated with the human female external genitalia without or with the simulated pubic hair on the outside of the cosmetic human female crotch enhancer element to provide the human female wearer with subtle understated sexual expression and subtle non-verbal communication, short of exposing themselves when viewed on the outer crotch surface of a human female wearer's undergarments or outer garments of every day dress or casual usage or tight fitting clothing, body suits, swim suits, leotard, sports tights, or similarly thin or close-fitting outer garments and the like.

U.S. Pat. No. 5,749,101 issued to Briendel on May 12, 1998 entitled, "Men's Padded Brief" describes mens' padded brief. There is no focus on providing the simulated appearance of exaggerated curves and contours associated with the human female's external genitalia.

U.S. Pat. No. 5,996,120 issued to Balit on Dec. 7, 1999 entitled, "Swim And Body Suit Support System" describe a swim or body suit for providing better support. There is no focus on providing the simulated appearance of exaggerated curves and contours associated with the human female's external genitalia.

U.S. Pat. No. 6,174,217 issued to Judson on Jan. 16, 2001 entitled, "Undergarments With Multiple Inserts" focus on female undergarments with tummy-contacting or breast-contacting panel for inserts. There is no focus on providing the simulated appearance of exaggerated curves and contours associated with the human female's external genitalia.

U.S. Pat. No. 6,406,648 issued to Noel, et. al. on Jun. 18, 2002 entitled, "Method Of Making Shaped Foam Implements" describes a method of making three dimensional foam implement. There is no focus on providing the simulated appearance of exaggerated curves and contours associated with the human female's external genitalia.

None of the references suggest the usage of human female crotch enhancing articles to provide the human female wearer with subtle understated sexual expression and subtle non-verbal communication, short of exposing themselves when viewed on the outer crotch surface of a human female wearer's undergarments or outer garments of every day dress or casual usage or tight fitting clothing, body suits, swim suits, leotard, sports tights, or similarly thin or close-fitting outer garments and the like.

SUMMARY OF THE INVENTION

There exists a need for a female crotch enhancing article with or without flaps of the type for placement on the outer crotch portion of a female garment, or a female crotch enhancing article of the type insertable into the space between the outer cloth layer and an inner cloth layer of a human female garment's crotch, or a female crotch enhancing article of the type for placement on the body facing side of a human female garment's crotch; and with separate or integral cosmetic human female crotch enhancer volume which is at least partially or wholly formed by a cosmetic human female crotch enhancer element positioned on the human female garment's outer crotch portion or positioned on or within any combination of body facing side, outside or within the outer and inner layer of a human female garment's crotch which gives the simulated appearance of exaggerated contours and curves associated with the human female external genitalia without the pudendal cleft associated with the human female external genitalia; or with the simulated appearance of the exaggerated pudendal cleft associated with the human female external genitalia with all or any combination of labia majora as if spread open manually or as if the human female's thighs are far apart or as if labia majora is not spread open, labia minora, clitoris, clitoral hood and other externally visible parts of the female genitalia within the pudendal cleft as they appear to project out of the labia majora starting from anterior commissure of labia majora to posterior commissure of labia majora or part thereof associated with the human female external genitalia without or with the simulated pubic hair on the outside of the cosmetic human female crotch enhancer element to provide the human female wearer with subtle understated sexual expression and subtle non-verbal communication, short of exposing themselves when viewed on the outer crotch surface of a human female wearer's undergarments or lingerie or panty hose or outer garments of every day dress or casual usage or tight fitting clothing, body suits, swim suits, leotard, sports tights, or similarly thin or close-fitting outer garments or figure control garments or human female protective athletic garments and the like.

It is an also object of this invention to provide the wearer with an human female crotch enhancing article with a cosmetic crotch enhancer element which may be worn year round due to it's cosmetic appeal and for subtle, understated sexual signal that imparts sexual communication without being overt and a subtle simulated non-verbal communication and for personal expression, short of exposing themselves when viewed on the outer crotch surface of a human female wearer's undergarments, lingerie, panty hose or figure control garments or outer garments of every day dress or casual usage or tight fitting clothing, body suits, swim suits, leotard, sports tights, or similarly thin or close-fitting outer garments and the like.

It is also an object of this invention that the integral or separate cosmetic crotch enhancer element maintains sufficient integrity while worn such that it does not wrinkle, fold, disintegrate, tear or collapse during usage.

The human female crotch enhancing article and integral or separate cosmetic human female crotch enhancer element is made of transparent or translucent material or has a variety of colors and may be scented with various aromatic scents or artificial vaginal scents preferably without the potential of adverse reaction to the wearer's genitalia to further highlight the understated sexual signal that imparts sexual communication without being overt or a subtle simulated non-verbal communication and for personal expression.

DETAILED DESCRIPTION OF THE INVENTION

The present invention pertains to a female crotch enhancing article with or without flaps of the type for placement on the outer crotch portion of a female garment, or a female crotch enhancing article of the type insertable into the space between the outer cloth layer and an inner cloth layer of a human female garment's crotch, or a female crotch enhancing article of the type for placement on the body facing side of a human female garment's crotch; and with separate or integral cosmetic human female crotch enhancer volume which is at least partially or wholly formed by a cosmetic human female crotch enhancer element positioned on the human female garment's outer crotch portion or positioned within the outer and inner layer of a human female garment's crotch which gives the simulated appearance of exaggerated contours and curves associated with the human female external genitalia without the pudendal cleft associated with the human female external genitalia; or with the simulated appearance of the exaggerated pudendal cleft associated with the human female external genitalia with all or any combination of labia majora as if spread open manually or as if the human female's thighs are far apart or as if labia majora is not spread open, labia minora, clitoris, clitoral hood and other externally visible parts of the female genitalia within the pudendal cleft as they appear to project out of the labia majora starting from anterior commissure of labia majora to posterior commissure of labia majora or part thereof associated with the human female external genitalia to provide the human female wearer with subtle understated sexual expression or subtle non-verbal communication, short of exposing themselves when viewed on the outer crotch surface of a human female wearer's undergarments or lingerie or panty hose or outer garments of every day dress or casual usage or tight fitting clothing, body suits, swim suits, leotard, sports tights, or similarly thin or close-fitting outer garments or figure control garments or human female protective athletic garments and the like.

Figure 1:
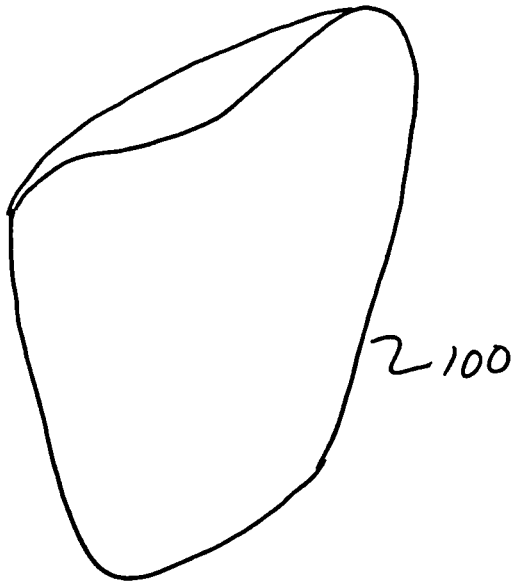
FIG. 1 is a perspective, schematic illustration of an embodiment of the present invention.
Figure 2:
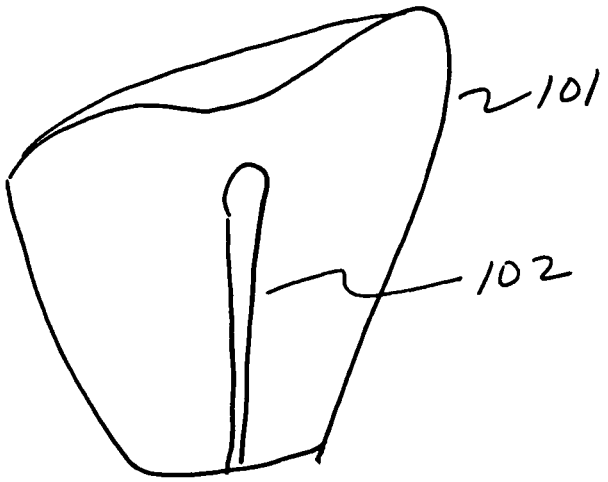
FIG. 2 is a perspective, schematic illustration of another embodiment of this invention showing the simulated and exaggerated pudendal cleft.

FIG. 1 is a perspective, schematic illustration of an embodiment of the present invention showing the human female crotch enhancing element without the simulated and exaggerated pudendal cleft as item 100. FIG. 2 is a perspective, schematic illustration of another embodiment of this invention showing the human female crotch enhancing element as item 101 with the simulated and exaggerated pudendal cleft as item 102.

Figure 3:
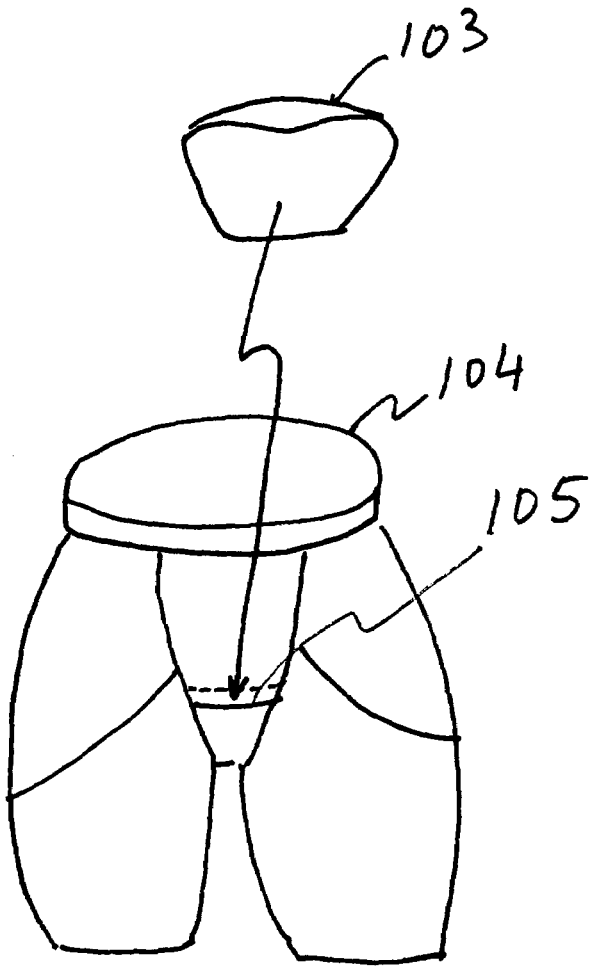
FIG. 3 is a perspective, schematic illustration of the placement of an integral or separate cosmetic crotch enhancer element into the space between the inner and outer crotch portion of the sports tights corresponding to FIG. 1.
Figure 4:
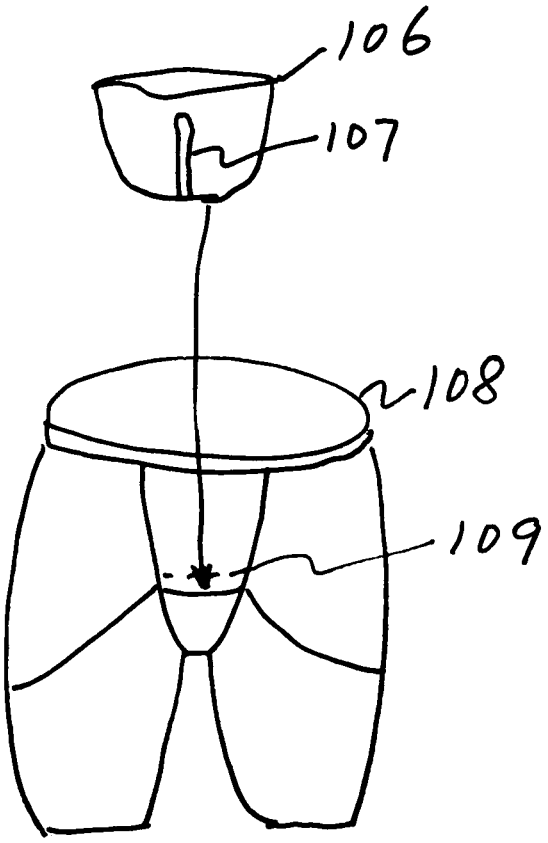
FIG. 4 is a perspective, schematic illustration of the placement of an integral or separate cosmetic crotch enhancer element with a simulated and exaggerated pudendal cleft into the inner and outer crotch portion of the sports tights corresponding to FIG. 2.
Figure 5:
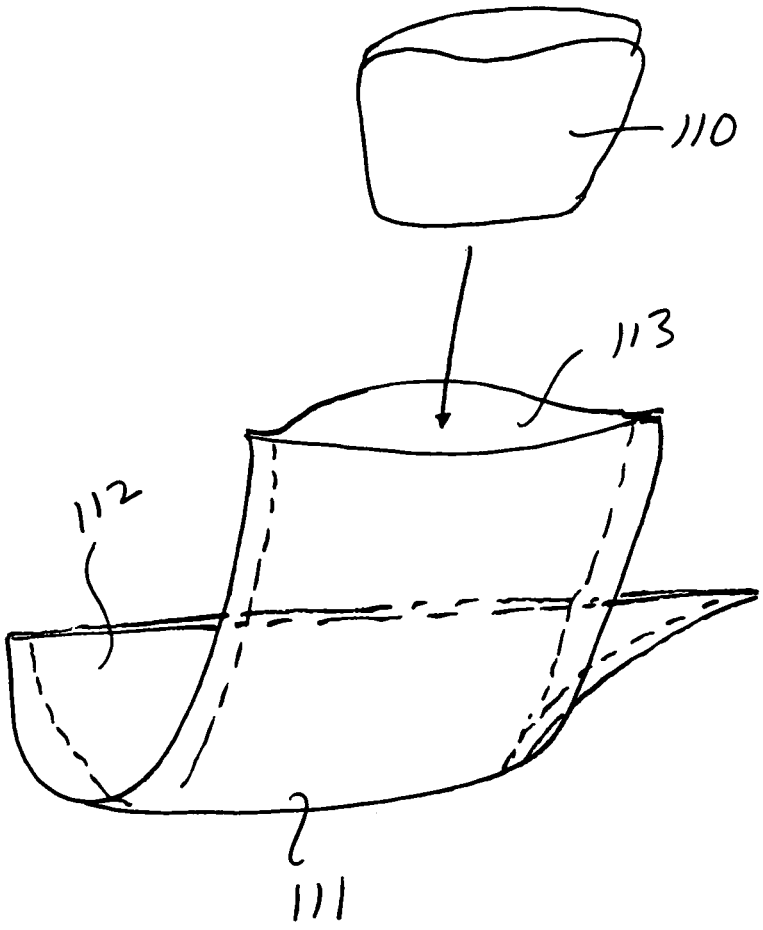
FIG. 5 is a perspective, schematic illustration of the placement of an integral or separate cosmetic crotch enhancer element insertable into the space between the outer cloth layer and an inner cloth layer of a human female garment's crotch corresponding to FIG. 1.
Figure 6:
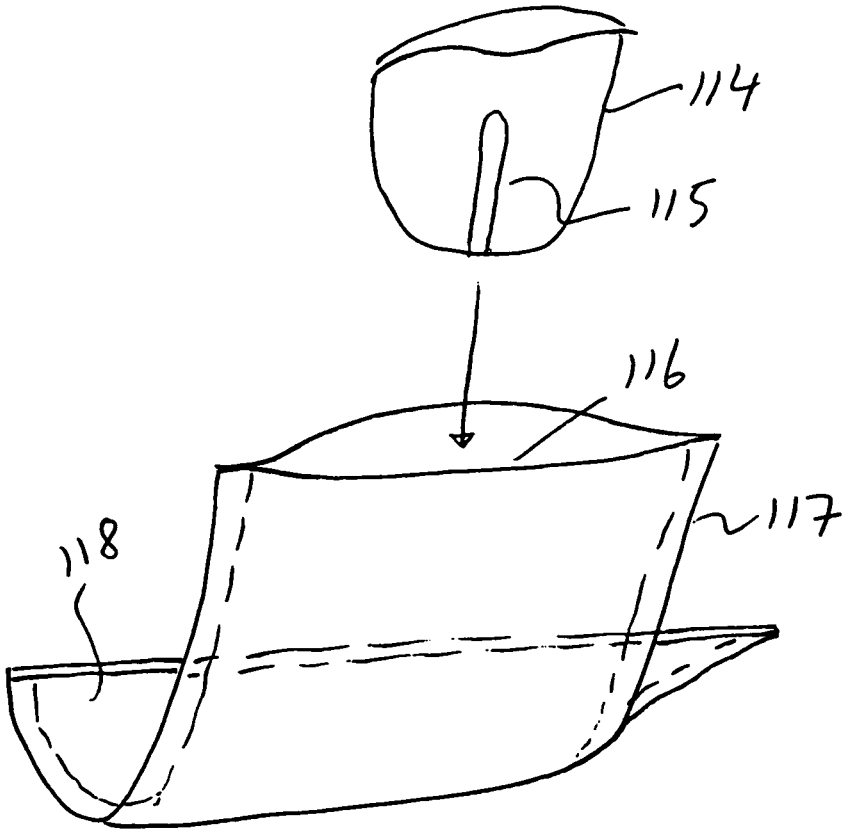
FIG. 6 is a perspective, schematic illustration of the placement of an integral or separate cosmetic crotch enhancer element with a simulated and exaggerated pudendal cleft insertable into the space between the outer cloth layer and an inner cloth layer of a human female garment's crotch corresponding to FIG. 2.
Figure 7:
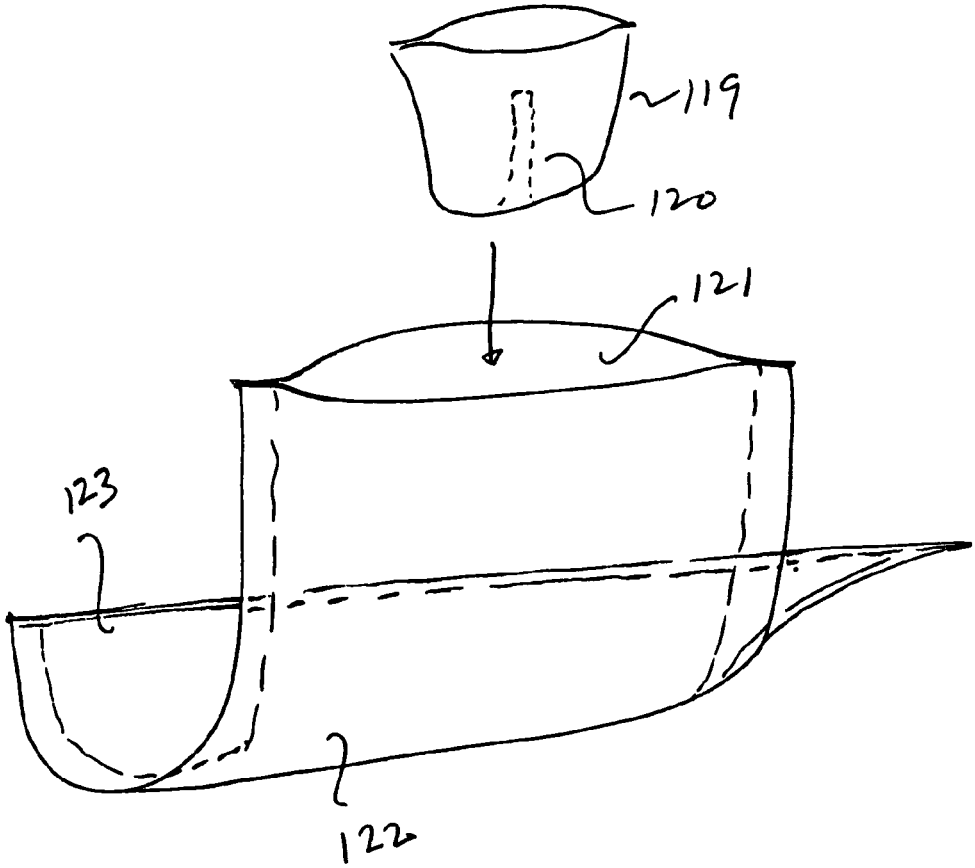
FIG. 7 is a perspective, schematic illustration of the placement of an integral or separate cosmetic crotch enhancer element with a simulated and exaggerated pudendal cleft is visible on one side only and is insertable into the space between the outer cloth layer and an inner cloth layer of a human female garment's crotch such that the simulated and exaggerated pudendal cleft faces the body of the human female wearer and the outer side of the integral or separate cosmetic crotch enhancer element gives the simulated appearance of exaggerated contours and curves associated with the human female external genitalia without the pudendal cleft associated with the human female external genitalia.

FIG. 3 is a perspective, schematic illustration of the placement of an integral or separate cosmetic crotch enhancer element as item 103 into the space between inner and outer crotch portion of the human female sports tights as item 104 corresponding to FIG. 1 with the inner crotch being represented by item 105. FIG. 4 is a perspective, schematic illustration of the placement of an integral or separate cosmetic crotch enhancer element as item 106 with a simulated and exaggerated pudendal cleft as item 107 the space between inner and outer crotch portion of the human female sports tights as item 108 corresponding to FIG. 2 with the inner crotch being represented by item 109. FIG. 5 is a perspective, schematic illustration of the placement of an integral or separate cosmetic crotch enhancer element as item 110 insertable into the space as item 113 between the outer cloth layer as item 111 and an inner cloth layer as item 112 of a human female garment's crotch corresponding to FIG. 1. FIG. 6 is a perspective, schematic illustration of the placement of an integral or separate cosmetic crotch enhancer element as item 114 with a simulated and exaggerated pudendal cleft as item 115 insertable into the space as item 116, between the outer cloth layer as item 117 and an inner cloth layer as item 118 of a human female garment's crotch corresponding to FIG. 2. FIG. 7 is a perspective, schematic illustration of the placement an integral or separate cosmetic crotch enhancer element as item 119 with a simulated and exaggerated pudendal cleft as item 120 is visible on one side only and is insertable into the space as item 121 between the outer cloth layer as item 122 and an inner cloth layer as item 123 of a human female garment's crotch such that the simulated and exaggerated pudendal cleft faces the body of the human female wearer and the outer side of the integral or separate cosmetic crotch enhancer element gives the simulated appearance of exaggerated contours and curves associated with the human female external genitalia without the pudendal cleft associated with the human female external genitalia.

Figure 8:
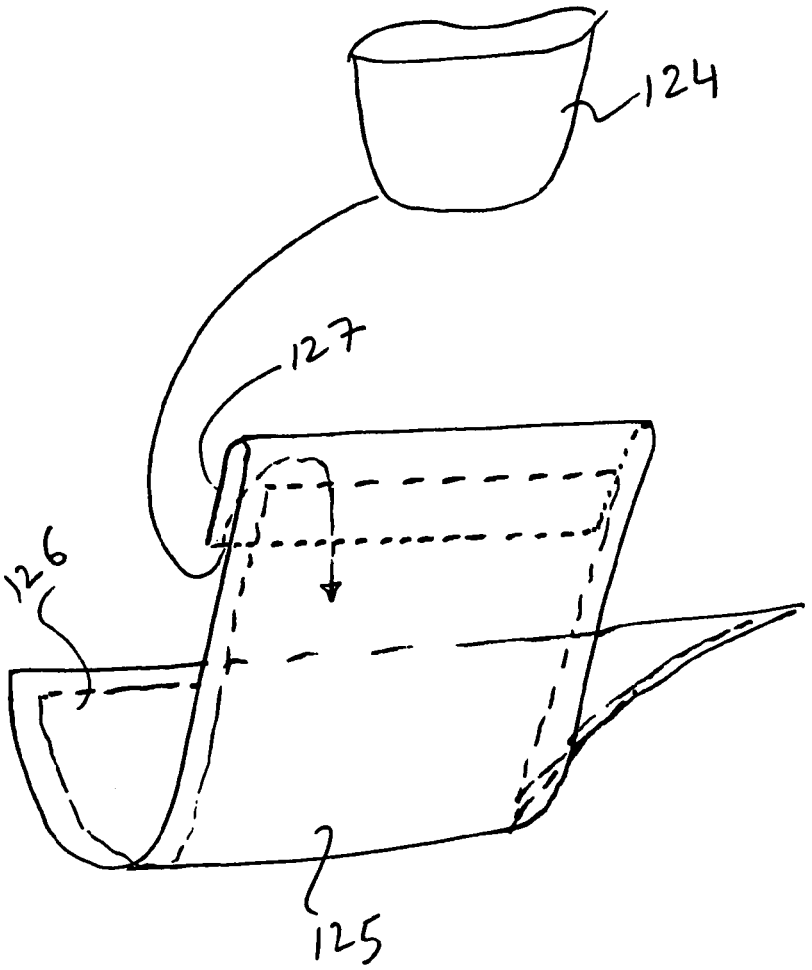
FIG. 8 is a perspective, schematic illustration of the placement of a separate cosmetic crotch enhancer element without a simulated and exaggerated pudendal cleft insertable into the space between the outer cloth layer and an inner cloth layer of a human female garment's crotch with a flap without or with fasteners corresponding to FIG. 1.
Figure 9:
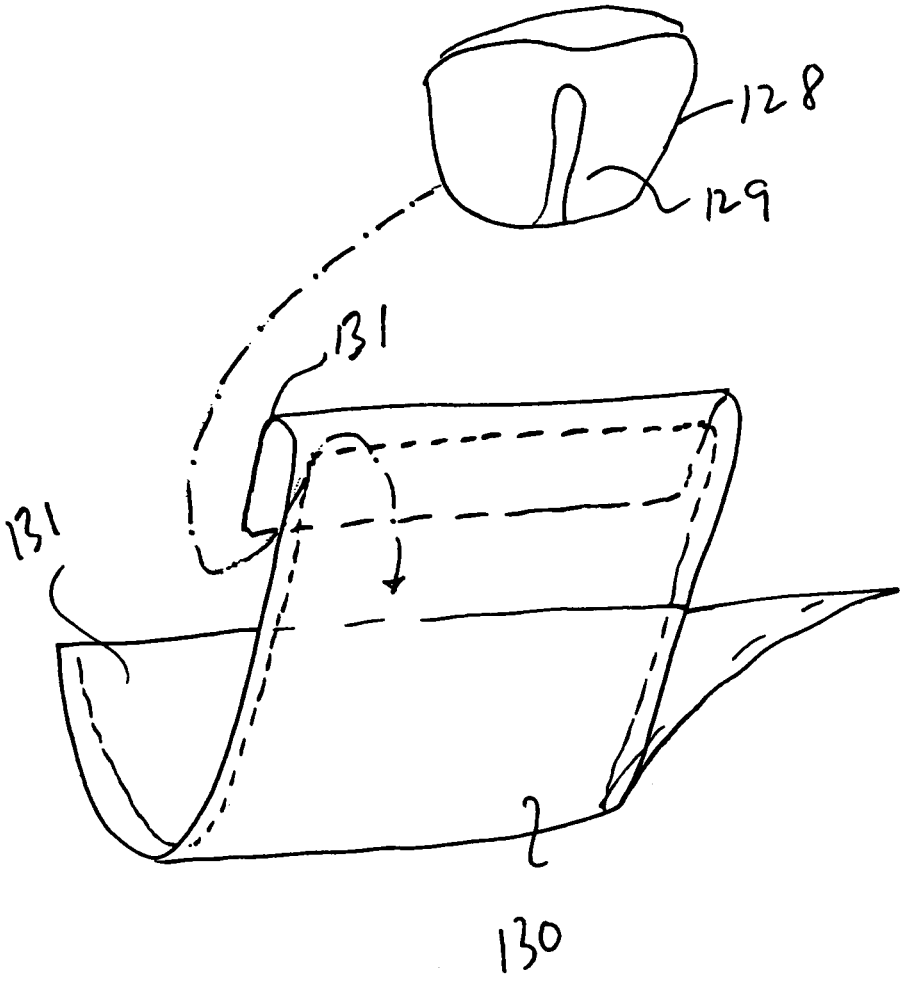
FIG. 9 is a perspective, schematic illustration of the placement of a separate cosmetic crotch enhancer element with a simulated and exaggerated pudendal cleft insertable into the space between the outer cloth layer and an inner cloth layer of a human female garment's crotch with a flap without or with fasteners corresponding to FIG. 2.
Figure 10:
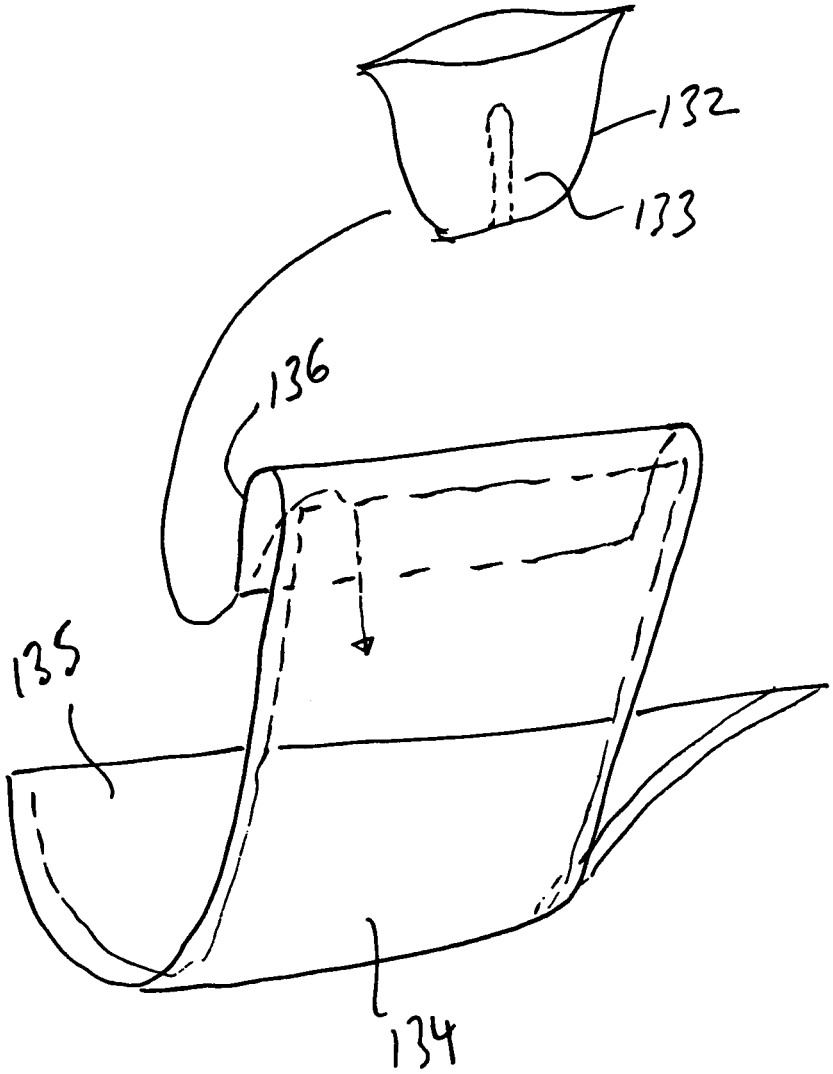
FIG. 10 is a perspective, schematic illustration of the placement of a separate cosmetic crotch enhancer element with a simulated and exaggerated pudendal cleft visible on one side only and insertable into the space between the outer cloth layer and an inner cloth layer of a human female garment's crotch with a flap without or with fasteners such that the simulated and exaggerated pudendal cleft faces the body of the human female wearer and the outer side of the integral or separate cosmetic crotch enhancer element gives the simulated appearance of exaggerated contours and curves associated with the human female external genitalia without the pudendal cleft associated with the human female external genitalia.

FIG. 8 is a perspective, schematic illustration of the placement of a separate cosmetic crotch enhancer element as item 124 without a simulated and exaggerated pudendal cleft insertable into the space between the outer cloth layer as item 125 and an inner cloth layer as item 126 of a human female garment's crotch with a flap without or with fasteners as item 127 corresponding to FIG. 1. FIG. 9 is a perspective, schematic illustration of the placement of a separate cosmetic crotch enhancer element as item 128 with a simulated and exaggerated pudendal cleft as item 129 insertable into the space between the outer cloth layer as item 130 and an inner cloth layer as item 131 of a human female garment's crotch with a flap without or with fasteners as item 131 corresponding to FIG. 2. FIG. 10 is a perspective, schematic illustration of the placement of a separate cosmetic crotch enhancer element as item 132 with a simulated and exaggerated pudendal cleft visible on one side only as item 133 and insertable into the space between the outer cloth layer as item 134 and an inner cloth layer as item 135 of a human female garment's crotch with a flap without or with fasteners as item 136 such that the simulated and exaggerated pudendal cleft faces the body of the human female wearer and the outer side of the integral or separate cosmetic crotch enhancer element gives the simulated appearance of exaggerated contours and curves associated with the human female external genitalia without the pudendal cleft associated with the human female external genitalia.

Figure 11:
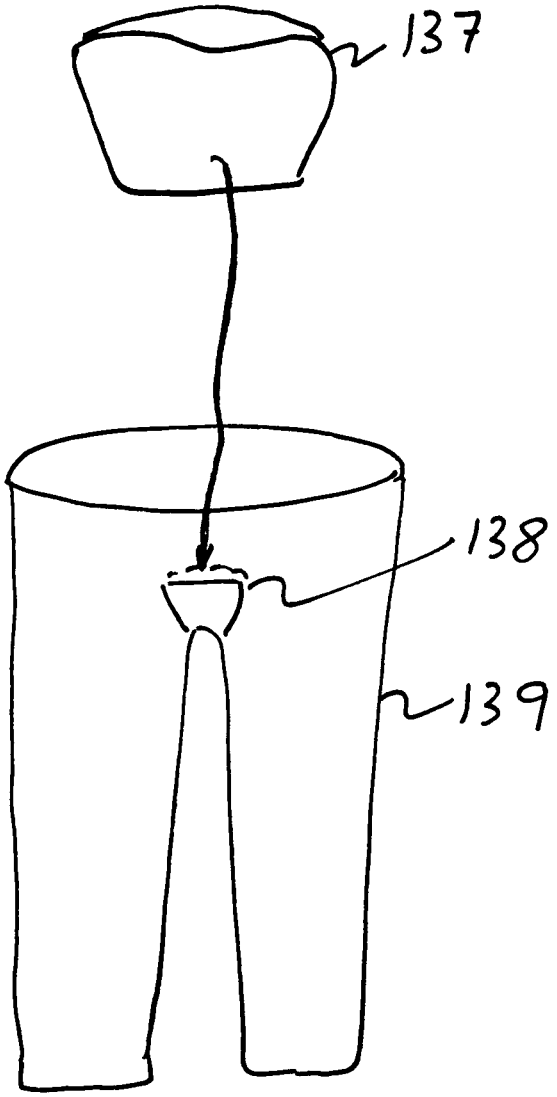
FIG. 11 is a perspective, schematic illustration of the placement of an integral or separate cosmetic crotch enhancer element into the space between the outer and inner crotch portion of the human female panty hose corresponding to FIG. 1.
Figure 12:
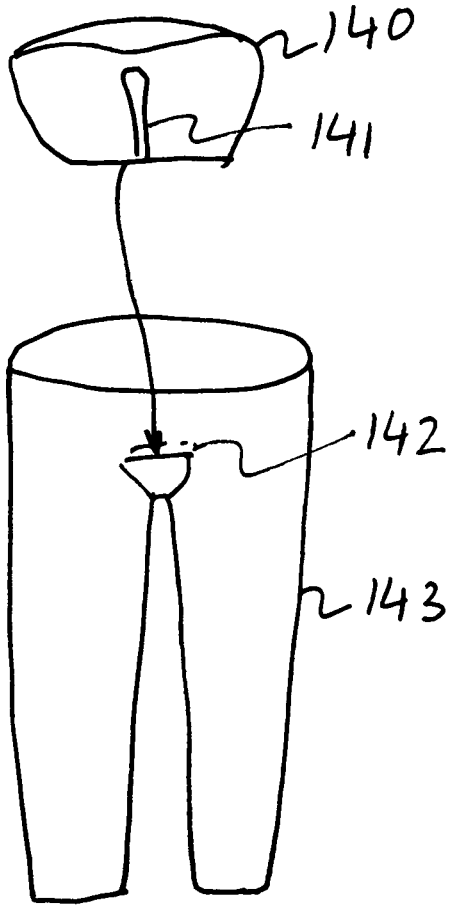
FIG. 12 is a perspective, schematic illustration of the placement of an integral or separate cosmetic crotch enhancer element with a simulated and exaggerated pudendal cleft into the space between the outer and inner crotch portion of the human female panty hose corresponding to FIG. 2.

FIG. 11 is a perspective, schematic illustration of the placement of an integral or separate cosmetic crotch enhancer element as item 137 onto the inner crotch portion as item 138 of human female panty hose corresponding to FIG. 1 with item 139 showing the outer crotch. FIG. 12 is a perspective, schematic illustration of the placement of an integral or separate cosmetic crotch enhancer element as item 140 with a simulated and exaggerated pudendal cleft as item 141 onto the inner crotch portion as item 142 of the human female panty hose corresponding to FIG. 2 with item 143 showing the outer crotch.

Figure 13:
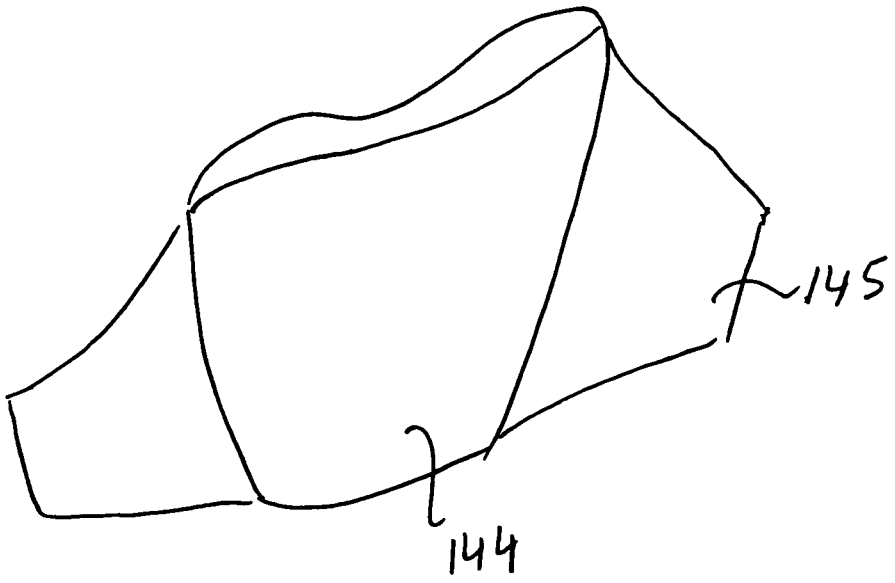
FIG. 13 is a perspective, schematic illustration of another embodiment of the present invention with flaps.
Figure 14:
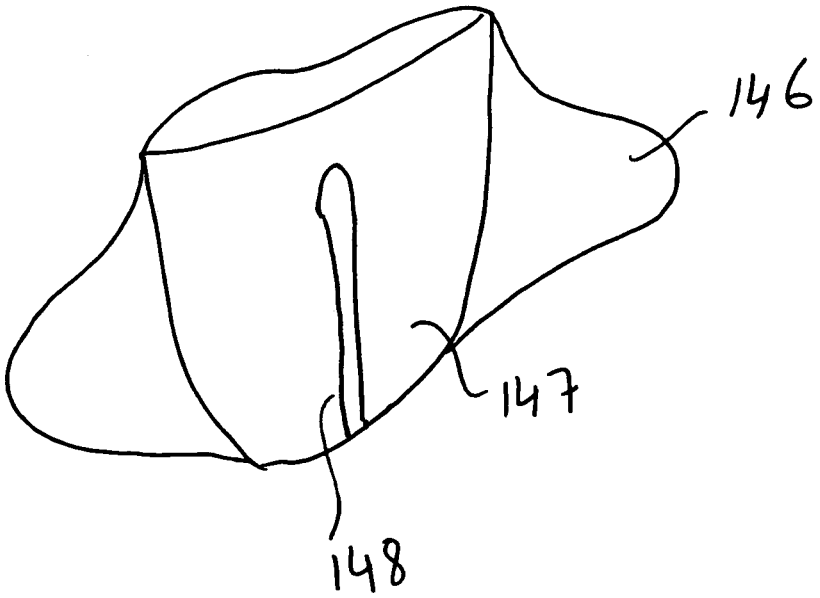
FIG. 14 is a perspective, schematic illustration of another embodiment of this invention showing the simulated and exaggerated pudendal cleft with flaps.
Figure 15:
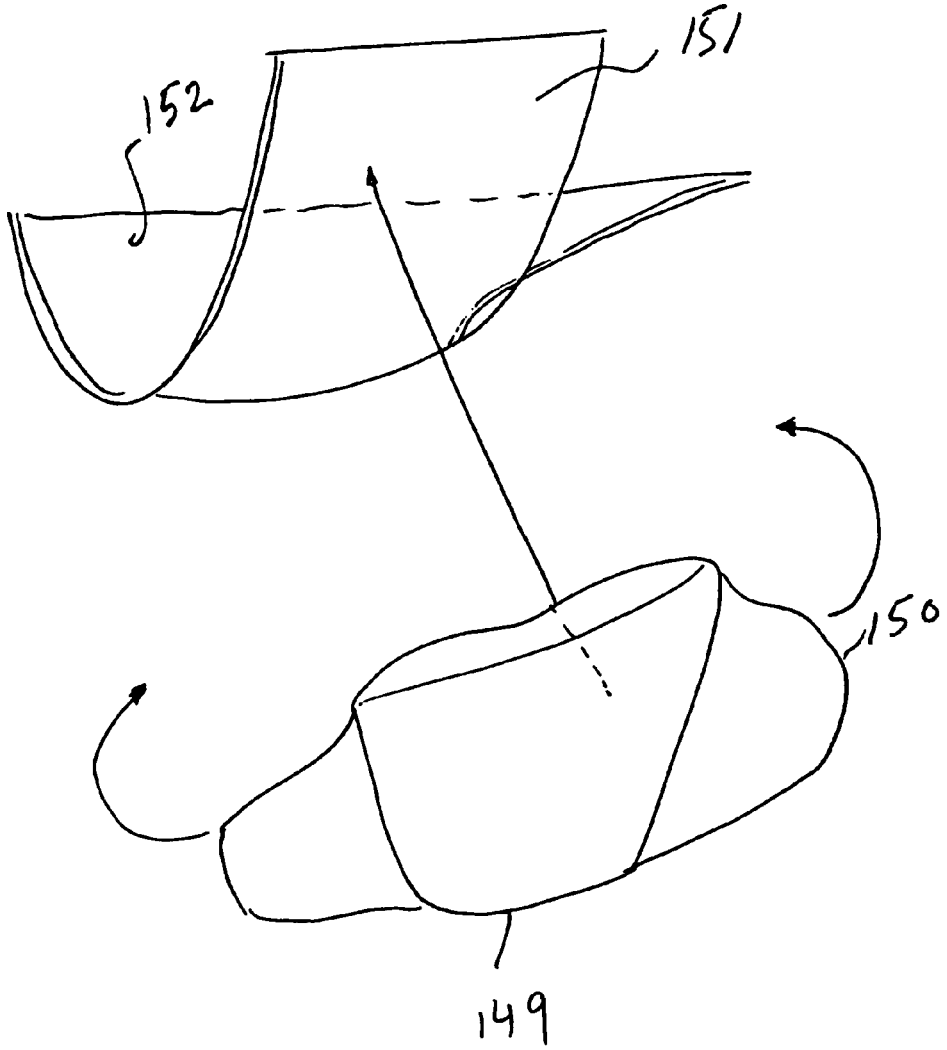
FIG. 15 is a perspective, schematic illustration of the placement of the integral or separate cosmetic crotch enhancer element with flaps onto the outer crotch portion of the undergarment or lingerie corresponding to FIG. 13.
Figure 16:
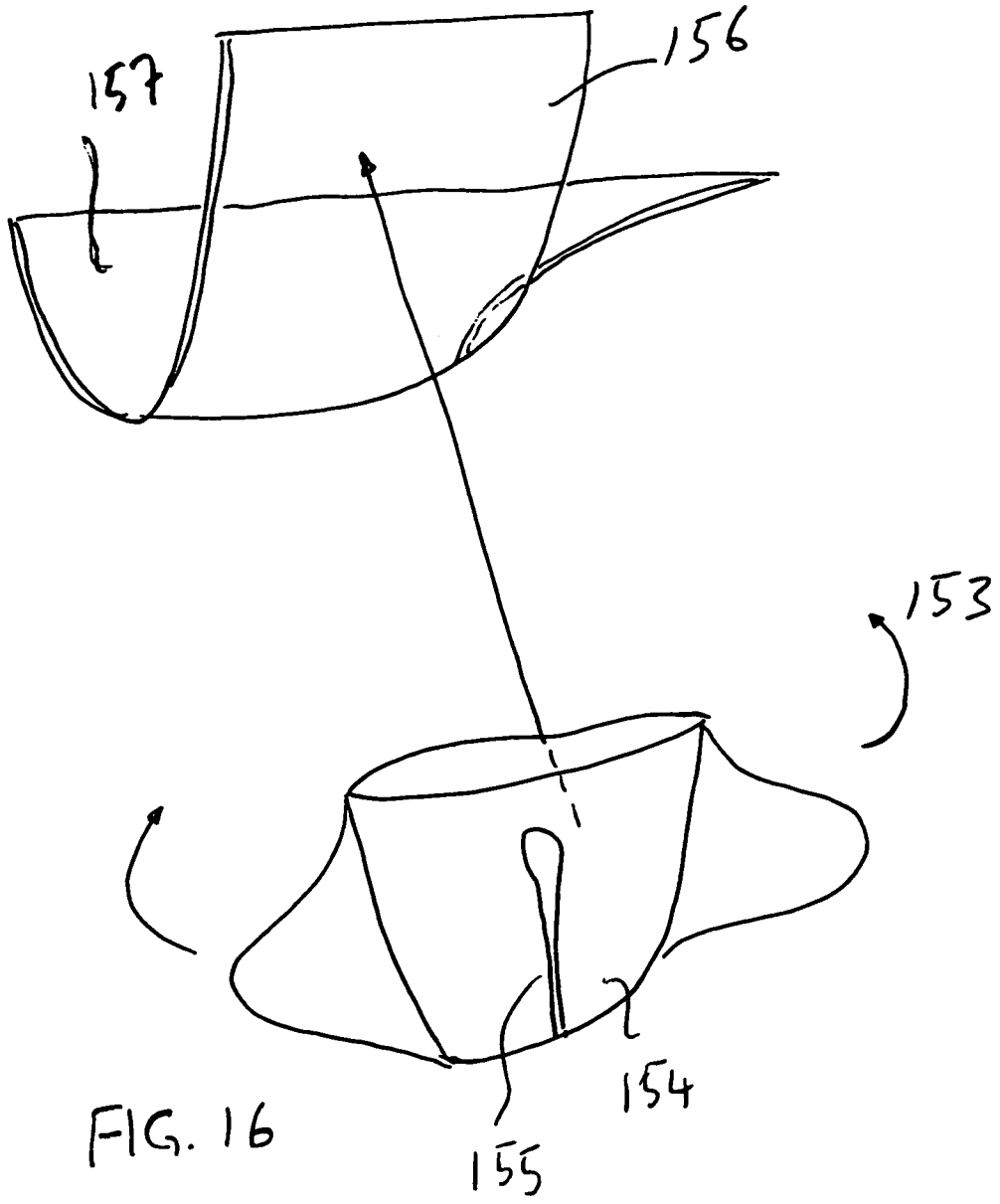
FIG. 16 is a perspective, schematic illustration of the placement of the integral or separate cosmetic crotch enhancer element with flaps with a simulated and exaggerated pudendal cleft onto the outer crotch portion of the undergarment or lingerie corresponding to FIG. 14.
Figure 17:
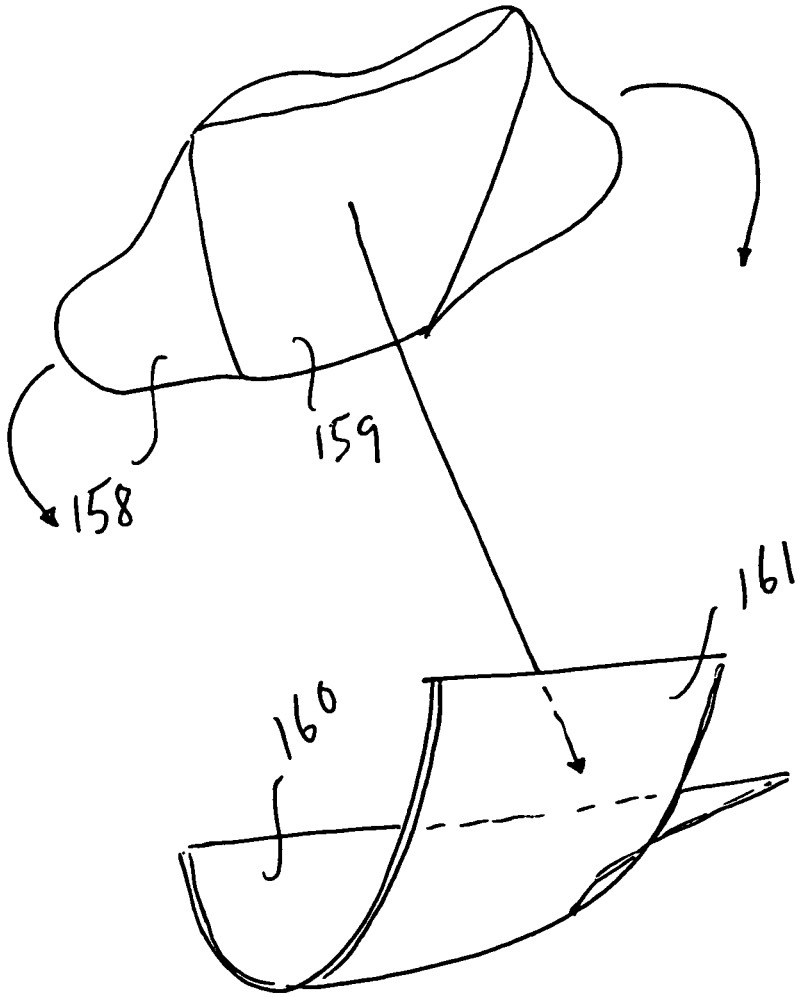
FIG. 17 is a perspective, schematic illustration of the placement of the integral or separate cosmetic crotch enhancer element with flaps onto the inner crotch portion of the undergarment or lingerie corresponding to FIG. 13.
Figure 18:
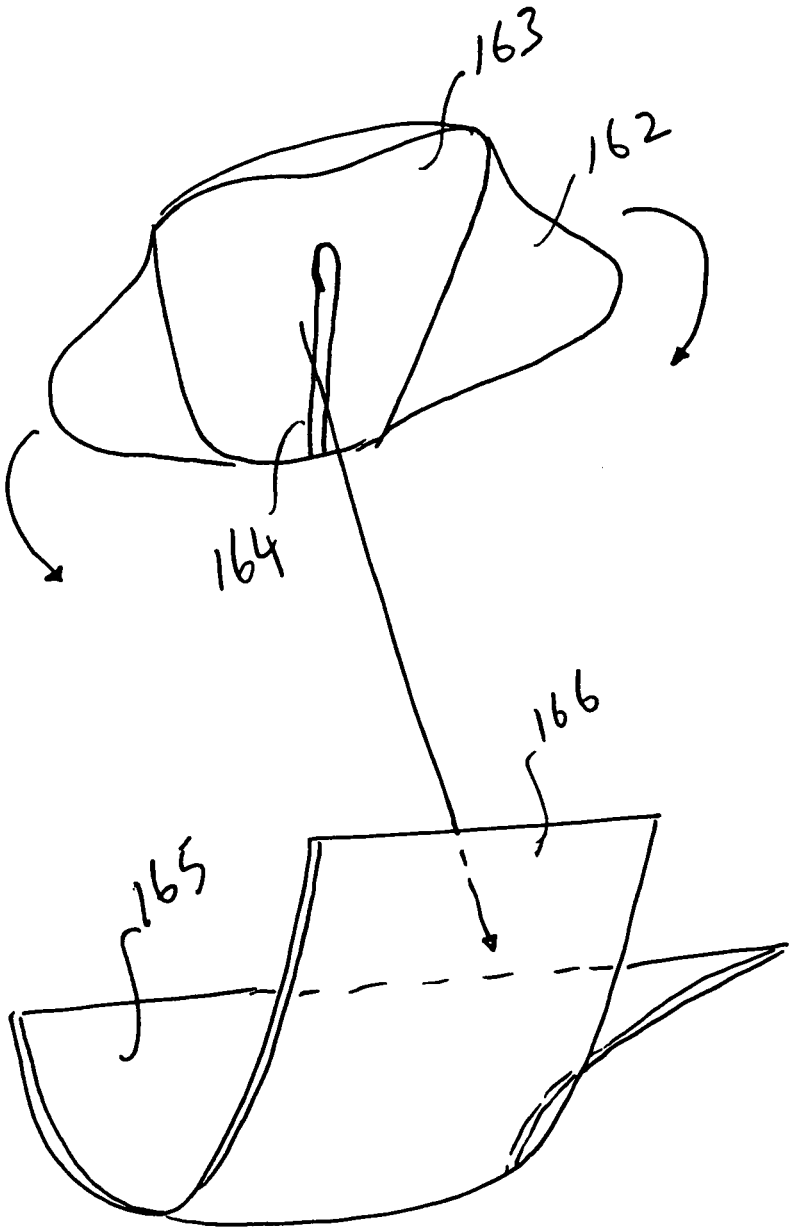
FIG. 18 is a perspective, schematic illustration of the placement of the integral or separate cosmetic crotch enhancer element with flaps with a simulated and exaggerated pudendal cleft onto the inner crotch portion of the undergarment or lingerie corresponding to FIG. 14.

FIG. 13 is a perspective, schematic illustration of another embodiment of the present invention as item 144 with flaps as item 145 on two sides. FIG. 14 is a perspective, schematic illustration of another embodiment of this invention as item 147 showing the simulated and exaggerated pudendal cleft as item 148 with flaps on two sides as item 146. FIG. 15 is a perspective, schematic illustration of the placement of the integral or separate cosmetic crotch enhancer element as item 149 with flaps as item 150 onto the outer crotch portion as item 151 of the undergarment or lingerie corresponding to FIG. 13 with item 152 showing the inner crotch. FIG. 16 is a perspective, schematic illustration of the placement of the integral or separate cosmetic crotch enhancer element as item 154 with flaps as item 153 with a simulated and exaggerated pudendal cleft as item 155 onto the outer crotch portion as item 156 of the undergarment or lingerie corresponding to FIG. 14 with item 157 showing the inner crotch. FIG. 17 is a perspective, schematic illustration of the placement of the integral or separate cosmetic crotch enhancer element as item 159 with flaps as item 158 onto the inner crotch portion as item 160 of the undergarment or lingerie corresponding to FIG. 13 with item 161 showing the outer crotch. FIG. 18 is a perspective, schematic illustration of the placement of the integral or separate cosmetic crotch enhancer element as item 163 with flaps as item 162 with a simulated and exaggerated pudendal cleft as item 164 onto the inner crotch portion as item 165 of the undergarment or lingerie corresponding to FIG. 14 with item 166 showing the outer crotch.

Figure 19:
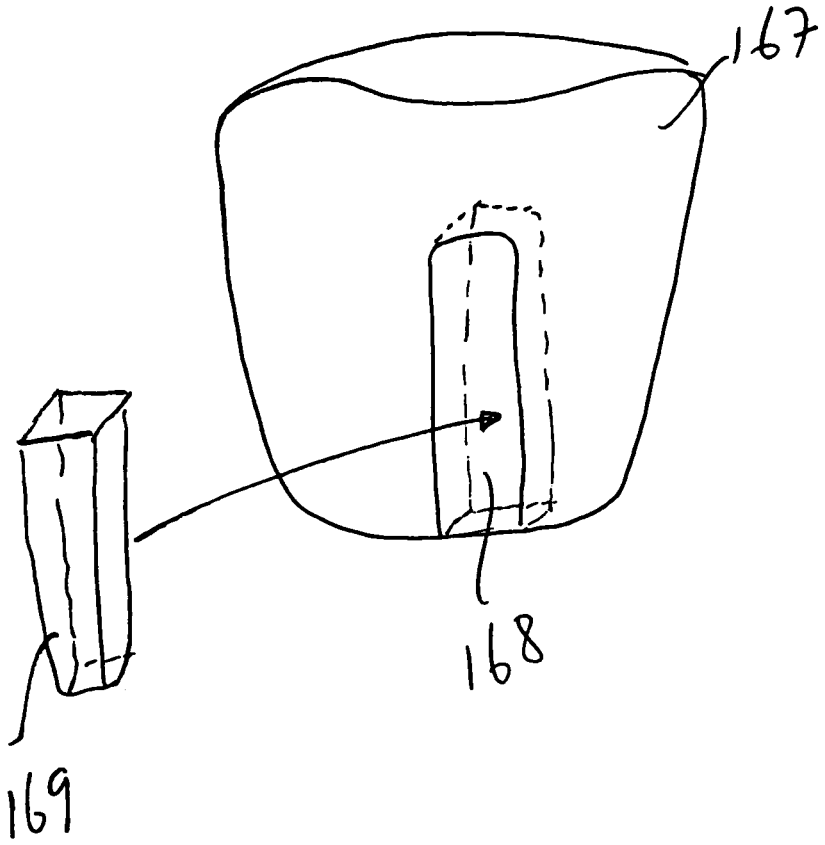
FIG. 19 is a perspective, schematic illustration yet another embodiment of the integral or separate cosmetic crotch enhancer element with the simulated and exaggerated pudendal cleft which may be closed by inserting an equivalent volume made up of the volume associated just with the said simulated and exaggerated pudendal cleft or the simulated and exaggerated pudendal cleft may be made visible by removing an equivalent volume made up of the volume associated just with the said simulated and exaggerated pudendal cleft.

FIG. 19 is a perspective, schematic illustration yet another embodiment of the integral or separate cosmetic crotch enhancer element as item 167 with the simulated and exaggerated pudendal cleft as item 168 which may be closed by inserting an equivalent volume as item 169 made up of the volume associated just with the said simulated and exaggerated pudendal cleft as item 168 or the simulated and exaggerated pudendal cleft as item 168 may be made visible by removing an equivalent volume made up of the volume associated just with the said simulated and exaggerated pudendal cleft as item 169.

Figure 20:
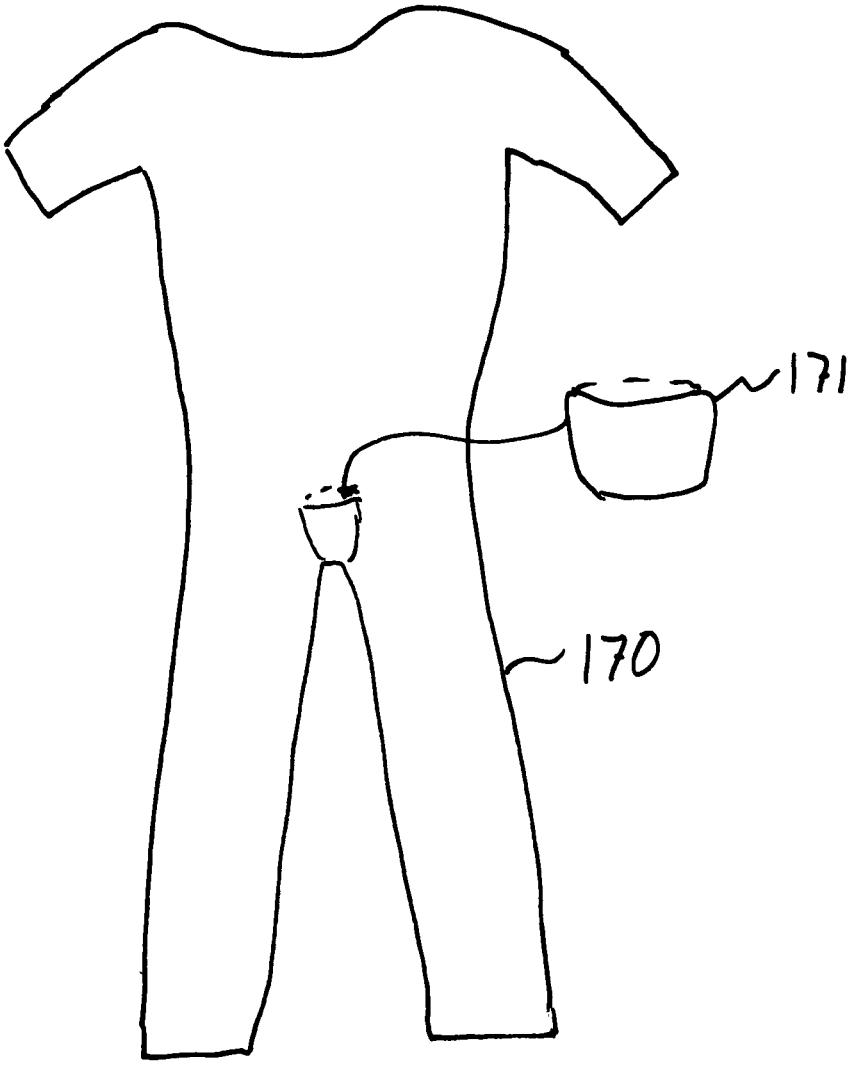
FIG. 20 is a perspective, schematic illustration of the placement of the integral or separate cosmetic crotch enhancer element the space between the inner and outer crotch portion of the human female body suit corresponding to FIG. 2.
Figure 21:
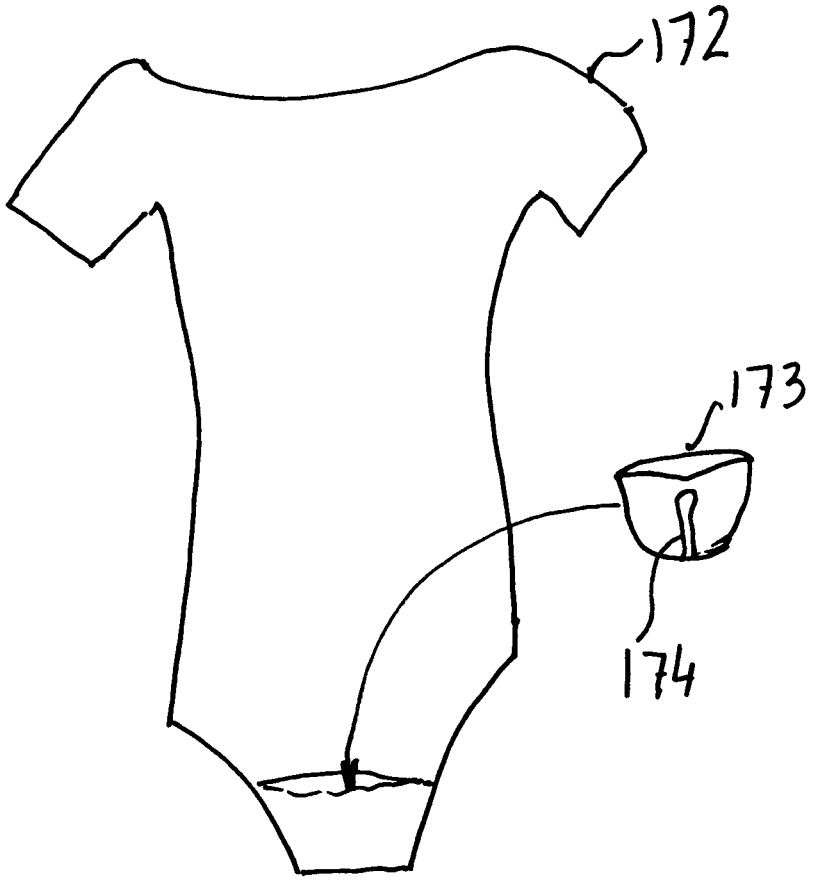
FIG. 21 is a perspective, schematic illustration of the placement of the integral or separate cosmetic crotch enhancer element with a simulated and exaggerated pudendal cleft into the space between the inner and outer crotch portion of the human female figure control garment corresponding to FIG. 2 of a leotard or one-piece swim suit.
Figure 22:
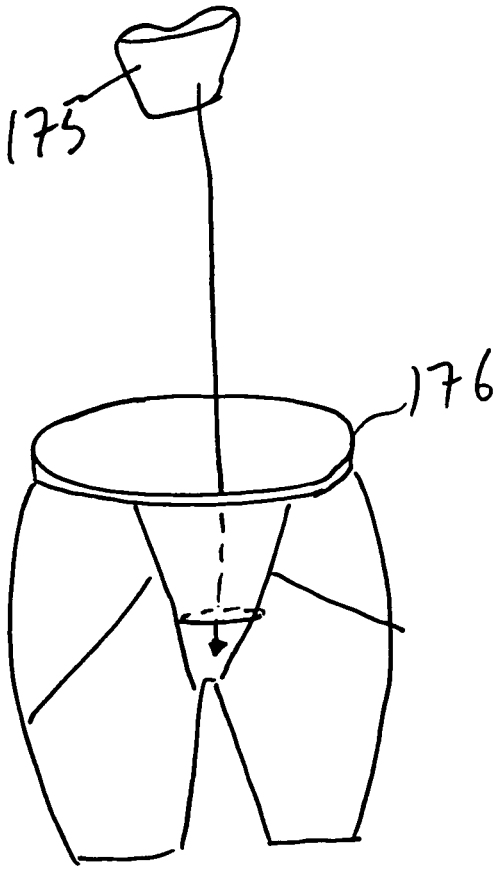
FIG. 22 is a perspective, schematic illustration of the placement of the integral or separate cosmetic crotch enhancer element in between the space between the outer and the inner crotch portion of the human female figure control garment corresponding to FIG. 1.
Figure 23:
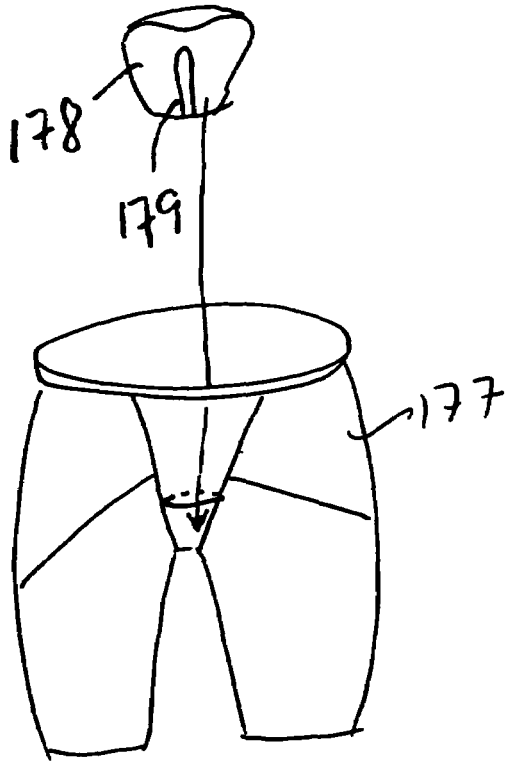
FIG. 23 is a perspective, schematic illustration of the placement of the integral or separate cosmetic crotch enhancer element with a simulated and exaggerated pudendal cleft in between the space between the outer and the inner crotch portion of the human female figure control garment corresponding to FIG. 2.

FIG. 20 is a perspective, schematic illustration of the placement of the integral or separate cosmetic crotch enhancer element as item 171 onto the outer crotch portion as item 170 of the human female figure body suit corresponding to FIG. 1. FIG. 21 is a perspective, schematic illustration of the placement of the integral or separate cosmetic crotch enhancer element as item 173 with a simulated and exaggerated pudendal cleft as item 174 onto the outer crotch portion as item 172 of the human female leotard or swim suit corresponding to FIG. 2. FIG. 22 is a perspective, schematic illustration of the placement of the integral or separate cosmetic crotch enhancer element as item 175 onto the inner crotch portion of the human female figure control garment as item 176 corresponding to FIG. 1. FIG. 23 is a perspective, schematic illustration of the placement of the integral or separate cosmetic crotch enhancer element as item 178 with a simulated and exaggerated pudendal cleft as item 179 onto the inner crotch portion of the human female figure control garment as item 177 corresponding to FIG. 2.

Figure 24:
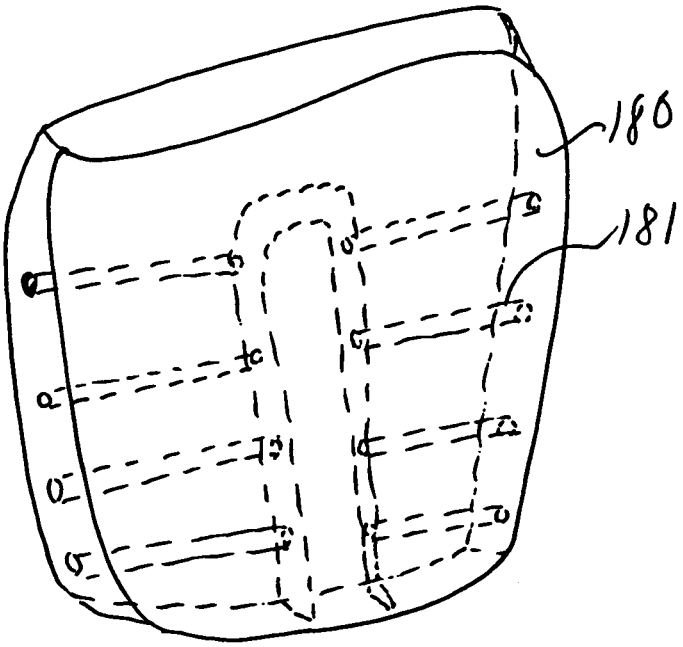
FIG. 24 is a perspective, schematic illustration of yet another embodiment of the present invention with ventilation
Figure 25:
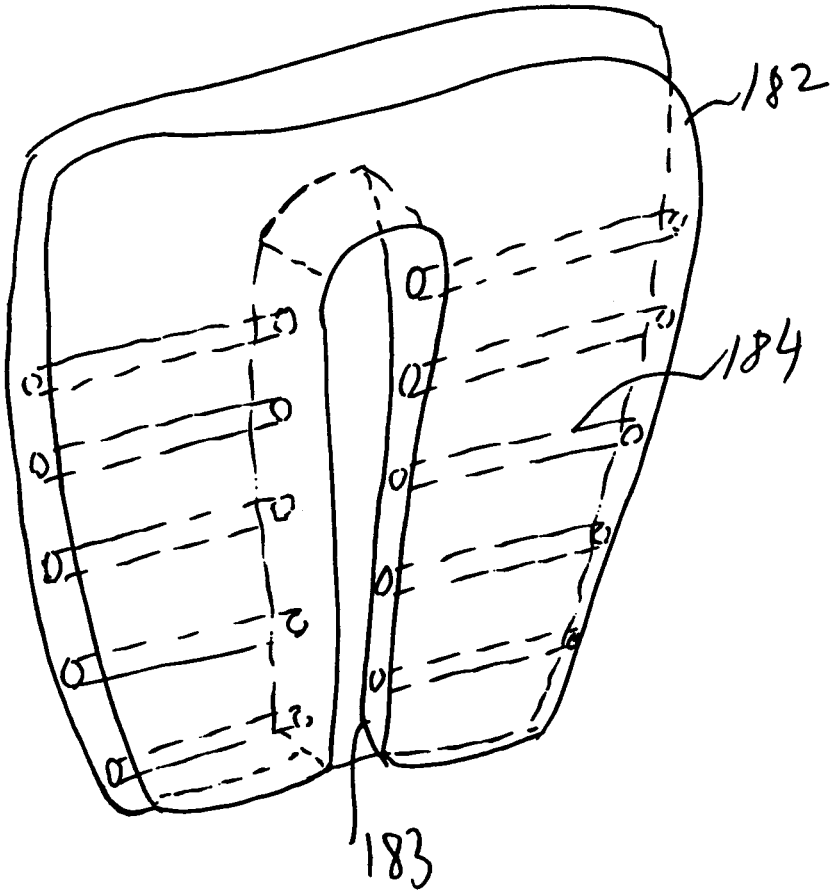
FIG. 25 is a perspective, schematic illustration of another embodiment of this invention showing the simulated and exaggerated pudendal cleft with ventilation.
Figure 26:
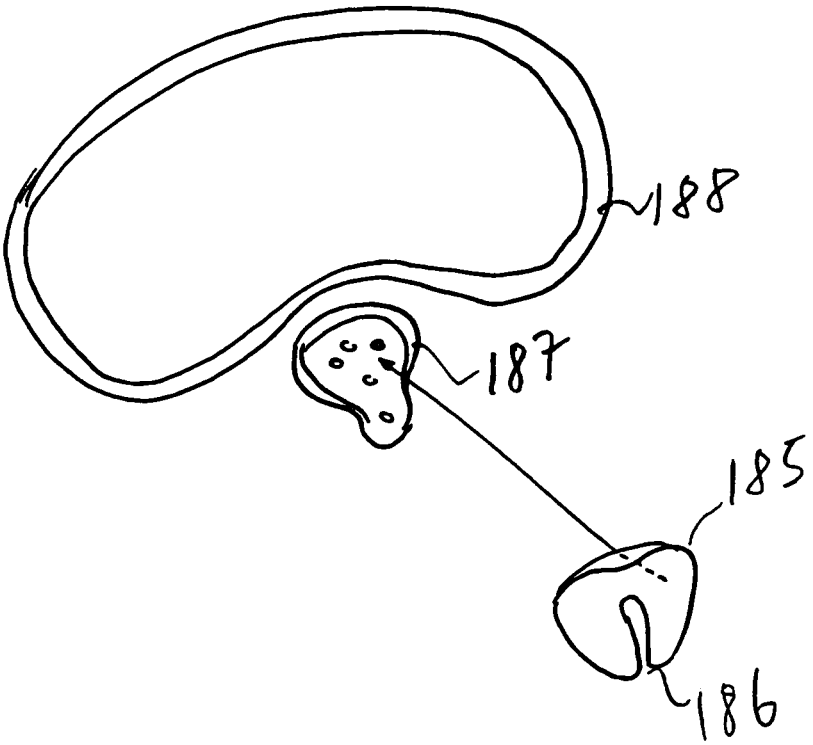
FIG. 26 is a perspective, schematic illustration of the placement of the separate cosmetic crotch enhancer element with a simulated and exaggerated pudendal cleft onto the outer crotch portion of the human female protective athletic garment corresponding to FIG. 2.
Figure 27:
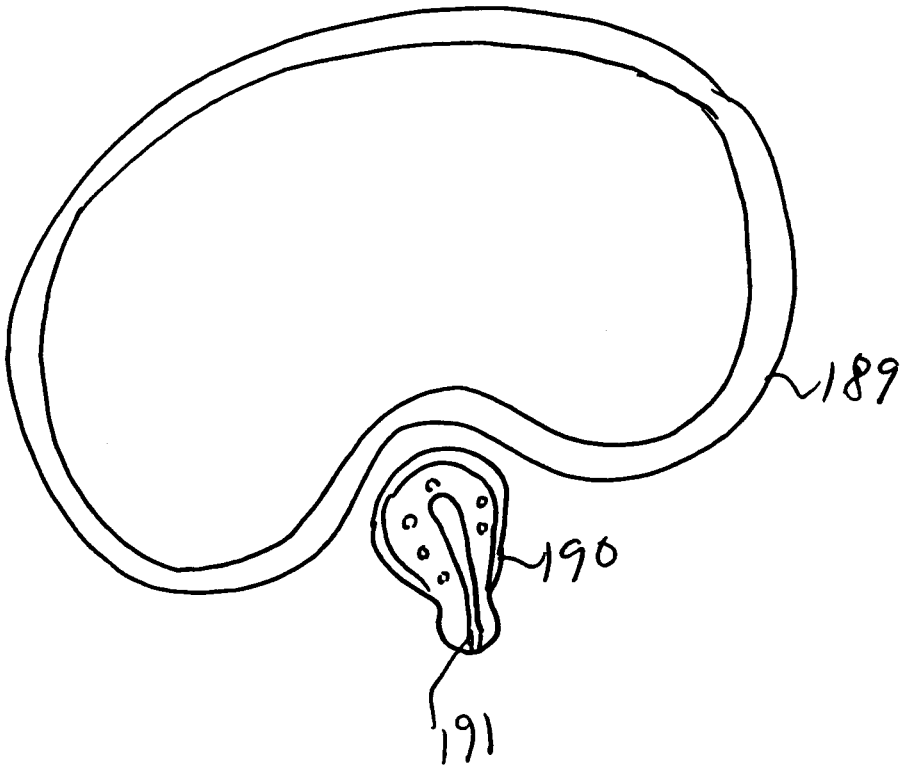
FIG. 27 is a perspective, schematic illustration of the placement of the integral cosmetic crotch enhancer element with a simulated and exaggerated pudendal cleft onto the outer crotch portion of the human female protective athletic garment corresponding to FIG. 2.

FIG. 24 is a perspective, schematic illustration of yet another embodiment as item 180 of the present invention with ventilation as item 181. FIG. 25 is a perspective, schematic illustration of another embodiment of this invention as item 182 showing the simulated and exaggerated pudendal cleft as item 183 with ventilation as item 184. FIG. 26 is a perspective, schematic illustration of the placement of the separate cosmetic crotch enhancer element as item 185 with a simulated and exaggerated pudendal cleft as item 186 onto the outer crotch portion of item 188 as the human female protective athletic garment as item 187 corresponding to FIG. 2. FIG. 27 is a perspective, schematic illustration of the placement of the integral cosmetic crotch enhancer element as item 190 with a simulated and exaggerated pudendal cleft as item 191 onto the outer crotch portion of item 189 as the human female protective athletic garment corresponding to FIG. 2.

It is suggested that the human female wearer of the human female crotch enhancing article of this invention will take normal precautions and responsible usage and safety to protect from undesirable or unwanted situations.

The cosmetic human female crotch enhancer element may be made of materials such as polyurethane foam, sponge, foam rubber material, soft plastic, feathers, cloth, cotton, cotton fiber, leather and the like. The soft and absorbent material on the body facing side of some embodiments of cosmetic human female crotch enhancer element may be any absorbent material that is capable of absorbing or retaining excretions from the human female genitalia. The absorbent material may be a wide variety of liquid-absorbent materials commonly used in sanitary napkins and other human female crotch enhancing articles such as comminuted wood pulp which is generally referred to as airfelt. Examples of other suitable absorbent materials include creped cellulose wadding; meltblown polymers including coform; chemically stiffened, modified or cross-linked cellulosic fibers; synthetic fibers such as crimped polyester fibers; peat moss; tissue including tissue wraps and tissue laminates; absorbent foams; absorbent sponges; super absorbent polymers; absorbent gelling materials; or any equivalent material or combination of materials, or mixtures of these. The absorbent material may also partially comprise less absorbent or non-absorbent material, such as polyurethane foam, which when combined with absorbent material (such as absorbent gelling materials), can be formed into suitable absorbent structures. Preferred absorbent materials are those mentioned above that are wet and dry resilient and can be formed into a resilient structure. Some absorbent foam materials are made from high internal phase emulsions, and are known as "HIPE" foams. Suitable HIPE absorbent foams are described in U.S. Pat. No. 5,260,345 issued to DesMarais, et al. on Nov. 9, 1993; U.S. Pat. No. 5,268,224 issued to DesMarais, et al. on Dec. 7, 1993; U.S. Pat. No. 5,387,207 issued to Dyer, et al. on Feb. 7, 1995; U.S. Pat. No. 5,550,167 issued to DesMarais on Aug. 27, 1996; U.S. Pat. No. 5,563,179 issued to Stone, et al. on Oct. 8, 1996; U.S. Pat. No. 5,650,222 issued to DesMarais, et al. on Jul. 22, 1997; and allowed U.S. patent application Ser. No. 08/542,497 filed Oct. 13, 1995, by Dyer. These patents may be referred to herein as the "Absorbent Foam Material" patents. Such absorbent foam materials are particularly preferred because they can be provided with good resistance to compression and resiliency following compression. Further, the cosmetic human female crotch enhancer element may be any less absorbent or non-absorbent material but not limited to polyurethane foam, particularly when the cosmetic human female crotch enhancer element does not provide any absorbent volume associated with the contours and curves.

The disclosure of all patents, patent applications (and any patents which issue thereon, as well as any corresponding published foreign patent applications), and any publications mentioned throughout this description are hereby incorporated by reference herein. It is expressly not admitted, however, that any of the documents incorporated by reference herein teach or disclose the present invention.

It should be understood that the foregoing description is only illustrative of the invention. Various alternatives and modifications can be devised, without departing from the spirit and scope of the invention.

What is claimed is:

1. A human female genitalia crotch enhancing article and garment combination comprising:

a cosmetic human female genitalia crotch enhancer volume component;

a human female garment having a crotch; said crotch having an outer layer and an inner layer forming a space there between;

said cosmetic human female genitalia crotch enhancer volume insertable into the said space there between the said outer layer and said inner layer of said human female garment's crotch; and said cosmetic human female genitalia crotch enhancer volume is structured to provide the simulated appearance of the exaggerated contours and curves of said female genitalia with the pudendal cleft associated with the human female external genitalia simulated thereon said enhancer volume.

2. The human female genitalia crotch enhancing article of claim 1 wherein said cosmetic human female genitalia crotch enhancer element volume without the said pudendal cleft is prevented from shifting in the said space there between the said outer layer and said inner layer by means of one of a group consisting of adhesive, fastener or being sewn within the said inner and outer layers.

3. The human female genitalia crotch enhancing article of claim 1 wherein said garment is one of the group consisting of lingerie, panty, panty hose, every day dress, casual usage clothing, tight fitting clothing, body suits, swim suits, leotard, sports tights, thin clothing, close-fitting outer clothing, figure control clothing or human female protective athletic garments.

* * * * *